US007086750B2

(12) United States Patent
Leyden et al.

(10) Patent No.: US 7,086,750 B2
(45) Date of Patent: Aug. 8, 2006

(54) SYSTEM FOR GENERATING A MESSAGE

(75) Inventors: Roger J. Leyden, Willow Springs, IL (US); Terrance J. Surma, Bloomingdale, IL (US); David A. Robinson, Sturgis, MI (US)

(73) Assignee: Se-Kure Controls, Inc., Franklin Park, IL (US)

( * ) Notice: Subject to any disclaimer, the term of this patent is extended or adjusted under 35 U.S.C. 154(b) by 208 days.

(21) Appl. No.: 10/601,391

(22) Filed: Jun. 23, 2003

(65) Prior Publication Data

US 2006/0133072 A1 Jun. 22, 2006

(51) Int. Cl.
*G08B 5/00* (2006.01)

(52) U.S. Cl. ..... 362/135; 362/276; 362/802; 340/815.4

(58) Field of Classification Search ..... 362/135, 362/128, 140, 276, 802, 147, 153, 125; 340/691.1, 340/691.6, 525, 5.91, 815.4, 815.53, 572.1; 348/143, 275; 40/431, 436, 446–447, 451–452, 40/591, 427, 541

See application file for complete search history.

(56) References Cited

U.S. PATENT DOCUMENTS

| | | | | |
|---|---|---|---|---|
| 5,231,393 | A * | 7/1993 | Strickland | 340/936 |
| 5,297,353 | A * | 3/1994 | Ghalayini | 40/503 |
| 6,446,375 | B1 * | 9/2002 | Davis | 40/597 |
| 6,676,272 | B1 * | 1/2004 | Chance | 362/128 |
| 6,982,649 | B1 * | 1/2006 | Blum et a. | 340/815.4 |

* cited by examiner

*Primary Examiner*—Thomas M. Sembar
*Assistant Examiner*—Guiyoung Lee
(74) *Attorney, Agent, or Firm*—Wood, Phillips, Katz, Clark & Mortimer

(57) ABSTRACT

A message system having a wall with opposite first and second sides. The wall has at least one of (a) a mirrored surface which is capable of producing a discernible, reflective image of an object placed at the first side of the wall, and (b) a blocking surface which substantially obstructs viewing of an object at the second side of the wall through the wall from the first side of the wall. The message system further includes a message generator capable of making a message viewable from the first side of the wall through at least a part of the wall.

32 Claims, 5 Drawing Sheets

SYSTEM FOR GENERATING A MESSAGE

BACKGROUND OF THE INVENTION

1. Field of the Invention

This invention relates to a system for generating a message and, more particularly, to a system for generating a message through a wall having at least one of (a) a mirrored surface and (b) a surface which prevents clear discerning of an object on one side of the wall through the wall from a vantage point at the other side of the wall.

2. Background Art

A multitude of different message systems have been devised, and continue to be devised, in different industries for purposes ranging from advertising to conveying cautionary information, as in warehouses, and elsewhere.

Those involved in the advertising industry are constantly seeking efficient and effective ways of attracting consumer attention to products and services. This task becomes even more challenging as potential consumers are bombarded with advertising information from various stores such as those selling groceries, alcoholic beverages, electronics, etc. Because of the number of industries that advertise, and to which consumers are exposed daily, consumers tend to become oblivious to the displays of such advertising information. As a result, much of the existing advertising in this environment becomes ineffective.

Another problem that contributes to the lack of effectiveness of conventional advertising in the store environments, or elsewhere, is the shear volume of displays of different products and services at any given location. As one example, in stores selling alcoholic beverages, it is common to see advertising posters for products applied to shelving and on walls and posters, and on displays suspended from ceilings and elsewhere. In the absence of some striking feature for this advertising material, the advertising materials may go virtually unnoticed to a considerable percentage of the potential consuming base. This problem is aggravated by the shortage of space in this type of store, as a result of which advertising is crowded into all usable space and upon virtually every exposed surface within the establishment.

Message generation in other environments may also be less than optimal for different reasons. As one example, effective message generation, often required in monitoring activities as in warehouses and the like, may not have the desired effectiveness.

Commonly, warehouses, manufacturing facilities, and the like, have a large number of personnel that traverse the space, preferably in a coordinated manner that promotes efficiency and safety. Oft times, this movement is assisted by static signage which identifies hazardous areas or alerts the workers of a desired traffic/equipment flow. Signage to perform this function may be generated on flooring, walls, or structures suspended from ceilings or provided on fixtures within the space.

By reason of the static nature of this type of signage, generally it inherently has a limited, effective life. While new workers may heed the warnings and directions of such signage, continued exposure and familiarity contribute eventually to passive consideration of the messages or potentially to their being altogether ignored. Designers of this type of signage likewise seek to provide this type of messaging in the most prominent location for its effectiveness to be realized and in a form that continues to engage the intended audience, regardless of the frequency of exposure thereto.

Another problem with informational systems, such as in warehouses, is that there is a scarcity of space to provide information in the most prominent locations to maximize effectiveness. For example, in warehouse environments, it is common to prominently locate visual guidance aids so that they can be clearly observed by equipment operators. For example, mirrors are commonly spotted around warehouses at locations where the user is "blind", i.e., at corners, between aisles, etc. The mirrors are located at heights and locations to be most readily visible to the operator of such equipment. Since the mirrors occupy the locations which are most consistently and obviously observed by equipment operators, any other information to be conveyed to the operators has been conventionally placed in less than optimal locations, apart from these mirrors.

To date, these mirrors have been one-dimensional in nature. That is, they perform strictly a reflective function. Any other information that is required to be conveyed must be provided on a separate structure, such as on the floor, walls, or ceiling, or using a separate structure that is mounted on any of these same surfaces. Aside from the inefficiency of having separate structures, some or all of the separate information may be displayed with less than the desired effectiveness.

Further, because of the need for several structures to support informational material, spaces may become cluttered. Aside from being unsightly, the multiple structures may at some point take up valuable space that is usable for other purposes or interfere with basic business operations.

The above problems apply generally to all types of message generating systems, regardless of the particular information being conveyed and regardless of the environment therefor. An ongoing challenge remains for those in the advertising industry to overcome the above problems and produce efficient, eye-catching message generating systems.

SUMMARY OF THE INVENTION

In one form, the invention is directed to a message system having a wall with opposite first and second sides. The wall has at least one of (a) a mirrored surface which is capable of producing a discernible, reflective image of an object placed at the first side of the wall, and (b) a blocking surface which substantially obstructs viewing of an object at the second side of the wall through the wall from the first side of the wall. The message system further includes a message generator capable of making a message viewable from the first side of the wall through at least a part of the wall.

In one form, the message generator has first and second states. With the message generator in the first state, a first message is viewable from the first side of the wall. With the message generator in the second state, a second message is viewable from the first side of the wall.

In one form, with the message generator in the first state has, a first message is viewable from the first side of the wall, and with the message generator in the second state, the first message is not viewable from the first side of the wall.

In one form, with the message generator in the first state, a message that repeatedly flashes is viewable from the first side of the wall and flashes at a first rate. With the message generator in the second state, a message that repeatedly flashes is viewable from the first side of the wall and flashes at a second rate that is different than the first rate.

In a still further form, with the message generator in the first state, a message that is viewable from the first side of the wall is generated for a first predetermined time interval. With the message generator in the second state, a message that is viewable from the first side of the wall is generated for a second predetermined time interval that is different than the first predetermined time interval.

In one form, the message generator has first and second states. In the first state the message generator causes a first message in a first language to be produced. In the second state, the message generator causes a message in a second language to be produced.

The message may take virtually any form and may be, for example, words, a logo, and/or a representation of an animate or inanimate object.

In one form, the message generator includes a light source.

The message may consist in whole or in part of a light beam.

In another form, the message may be at least one of (a) information regarding a product or service, and (b) information providing a direction to an observer of the message at the first side of the wall.

In one form, the message system includes a sensor to detect the presence of an individual or object at the first side of the wall and, as an incident thereof, cause the message generator to make a message viewable from the first side of the wall.

In one form, the mirrored surface has a convex shape at the first side of the wall.

The message system may further include a transmitter/generator for directing a signal to the message generator from a location spaced from the message generator.

The message system may further include a wheeled vehicle carrying the transmitter/generator.

In one form, the wall has a thickness and at least a part of the signal generator resides within the thickness of the wall.

In one form, the signal generator resides at the second side of the wall.

The message system may further include a surveillance camera on the second side of the wall which is capable of creating an image of an object on the first side of the wall viewed by the camera through the wall.

In one form, an object at the first side of the wall is viewable through the layer from the second side of the wall.

The invention is further directed to a message system having a wall with opposite first and second sides and a surface which substantially blocks viewing of an object at the second side of the wall through the wall from the first side of the wall. The message system further includes a message generator having first and second states. The message generator in the first state causes a first message to be viewable at the wall from the first side of the wall. The first message is unviewable from the first side of the wall with the message generator in the second state.

In one form, an object on the first side of the wall can be viewed through the wall from the second side of the wall.

In one form, the wall has a mirrored surface which is capable of producing a reflective image of an object placed at the first side of the wall.

In one form, the system includes a sensor to detect the presence of an individual or object at the first side of the wall and, as an incident thereof, cause the message generator to make a message viewable from the first side of the wall.

The message system may further include a transmitter/generator for directing a signal to the message generator from a location spaced from the message generator.

The mirrored surface may have a convex shape at the first side of the wall.

The message system may further include a wheeled vehicle carrying the transmitter/generator.

In one form, the wall has a thickness and at least a part of the signal generator resides within the thickness of the wall.

The message system may further include a surveillance camera on the second side of the wall which is capable of creating an image of an object on the first side of the wall viewed by the camera through the layer.

The message generator may have first and second states the same as those described with respect to the first form of the invention, above.

DETAILED DESCRIPTION OF THE DRAWINGS

Figure 1:
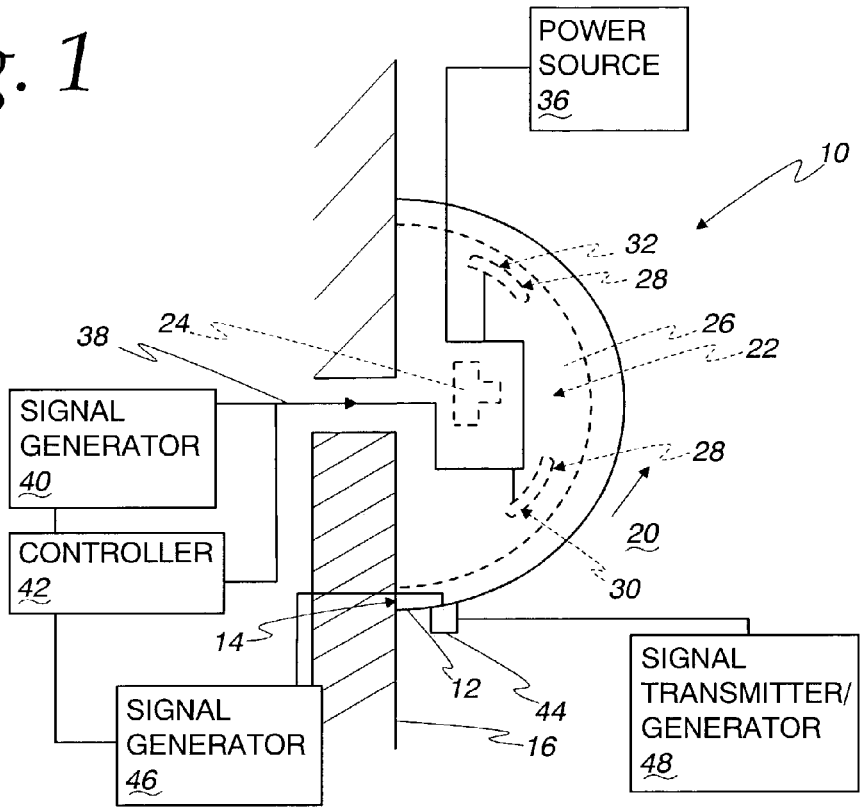
FIG. 1 is a partially schematic representation of a message system, according to the present invention, including a wall and a message generator for making a message viewable from a first side of the layer.
Figure 2:
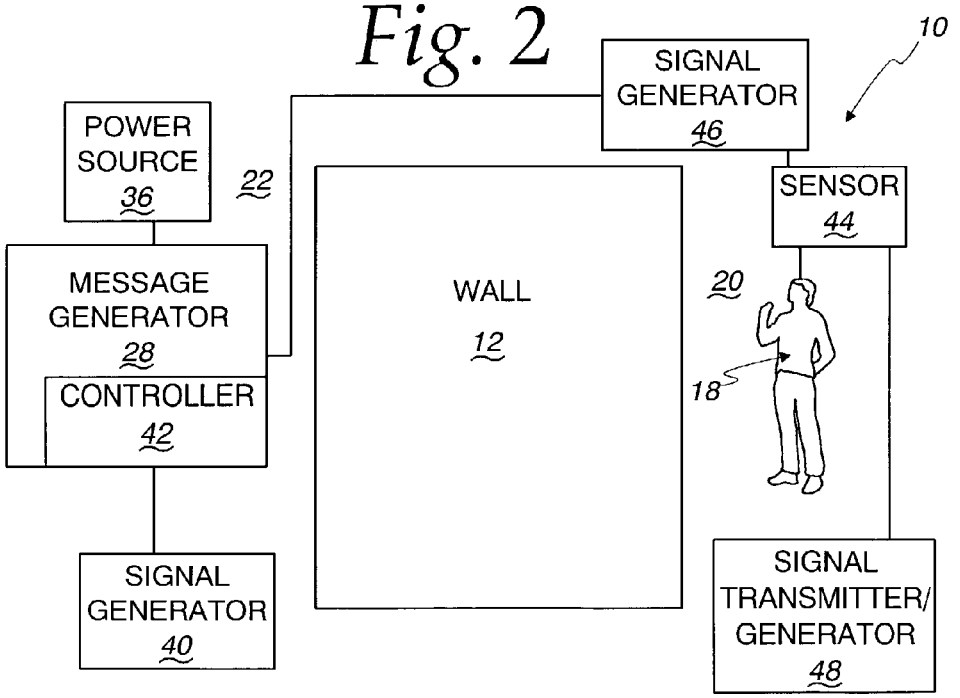
FIG. 2 is a schematic representation of the message system in FIG. 1.

In FIGS. 1 and 2, a message system, according to the present invention, is shown at 10. The message system 10 consists of a wall 12 that is formed into a convex shape, and in this embodiment a segment of a sphere. The wall has an annular edge 14 which permits flush mounting of the wall 12 against a flat surface 16 on a support that may be generally vertically or horizontally oriented.

In this particular embodiment, the wall 12 is made from a material, and has a construction, which produce a blocking surface which substantially obstructs viewing, by an observer 18 at a first side 20 of the wall 12, of an object on the opposite/second side 22 of the wall 12, through the wall 12. This type of construction is used commonly in retail establishments to allow a surveillance camera 24 to be placed in a space 26 bounded by the wall 12 on the second side 20 of the wall 12, to create an image of an object on the first side 20 of the wall 12 through the wall 12. The assignee of this invention currently offers such a product which is identified as its SMOKIE DOME® surveillance system.

In this form of the invention, a message generator 28 is provided on the second side 22 of the wall 12 and can be either abutted thereto or mounted in spaced relationship therewith. The message generator 28 is shown to be in two different regions 30,32 with respect to the wall 12, so as to allow a message, caused to be generated thereby, to be viewed by an observer at the first side 20 through the wall 12 at the separate wall regions 30,32.

The message produced through the message generator 28 can have virtually a limitless number of different forms and can be produced at one region, or alternatively defined by discrete message portions at different locations, which may be coordinated or independent to produce a desired effect. The nature of the message is likewise virtually limitless and may be dictated by the particular environment. As just an example, the message may be something as simple as a light beam/spot, or could alternatively be a complex design occupying a very substantial portion of the surface area of the wall 12. As just examples, the viewable message could be in the nature of words, a logo, or a representation of an animate or inanimate object. The message could provide information relating to the qualities or price of a product/service, or could provide a direction or assistance to an observer. The message may be cautionary in nature, assist the observer in navigating a particular space, etc. The invention does not contemplate any limitation in terms of the nature of the message or the environment in which it can be used.

The message generator 28 may be powered by an appropriate source. The power source 36 may be a battery. Alternatively, the power source 36 may be a 110 volt line.

The message generator 28 is described in greater detail below. It may cause a message to be generated that is defined entirely by light or highlighted by light.

Figure 3:
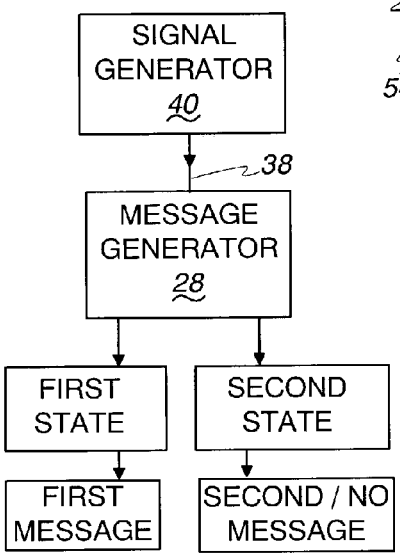
FIG. 3 is a flow diagram showing operation of the message system in FIGS. 1 and 2.

In one form, as shown schematically in FIG. 3, taken in conjunction with FIGS. 1 and 2, the message generator 28 is designed to have first and second different states. The state of the message generator 28 is dictated by a signal 38 from a signal generator 40. The signal generator 40 may be a switch that is either "on" or "off". In the on/first state, the message produced through the message generator 28 is viewable by an observer at the first side 20 of the wall 12. In the off/second state, the signal generator 40 is disabled and no message is produced thereby.

Alternatively, with the message generator 28 in the first state, a first message is viewable from the first side 20 of the wall 12, and with the message 28 in the second state, a second message is viewable at the first side 20 of the wall 12. As used herein, characterizing the message as different is intended to identify any variation in message which makes the first and second viewable messages nonidentical. For example, a different colored light may be projected. Alternatively, the first and second messages may be viewable at different regions on the layer 12. The messages may be different by reason of different color shading, or highlighting of an object associated with the wall 12.

The first and second states may be distinguishable by reason of a difference in how the message, viewable at the first side 20 of the wall 12, is generated. For example, with the message generator 28 in the first state, a message, viewable at the first side 20 of the wall 12, may be flashed repeatedly at a first rate. In the second state, the rate of flashing may be different.

The first and second states may be different by reason of the length of time that a particular message is flashed to be viewable from the first side 20 of the wall 12. For example, with the message generator 28 in the first state, a message viewable from the first side of the wall 12 may be flashed "on" and maintained in that state for a first predetermined interval. In the second state, the message viewable from the first side of the wall 12 may be flashed for an interval that is different, i.e., longer or shorter, than the first interval. The message generator 28 may incorporate a controller 42 through which the changes of state of the signal generator 40 can be effected.

The signal generator 40 may be manually operated to produce a desired change of state for the message generator 28. Alternatively, a sensor 44 may be provided to detect a condition and, as an incident thereof, cause a signal generator 46 to direct a signal to the controller 42 to change the state of the message generator 28. For example, the sensor 44 might be a motion sensor which detects the presence of an object, such as the observer 18 within a predetermined range of the wall 12.

Figure 4:
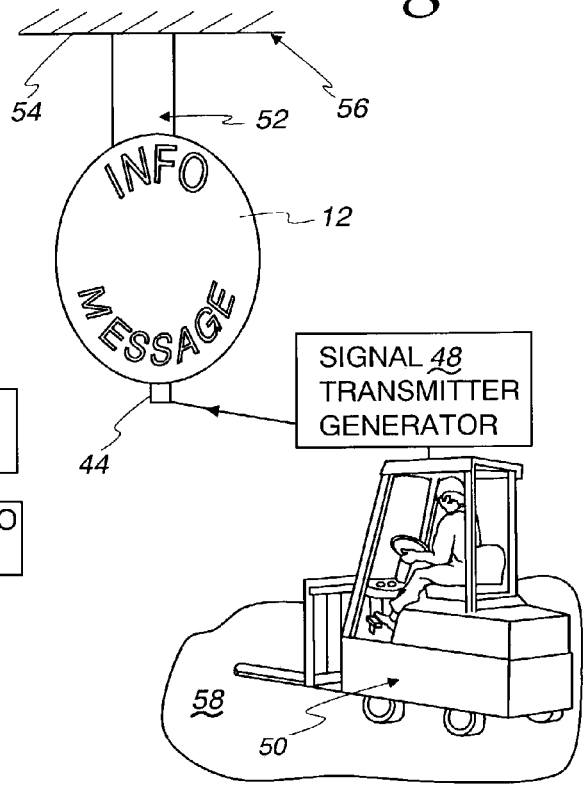
FIG. 4 is a perspective view of the message system of FIG. 1 with the wall mounted on a horizontal, downwardly facing surface and showing a forklift having a signal transmitter/generator thereon for directing a signal to the message generator to change the state of the message generator and thus the nature of a message viewable from the first side of the wall.

As a still further alternative, a signal transmitter/generator 48 can direct a signal to the sensor 44 to activate the signal generator 46 to change the state of the message generator 28. The signal transmitter/generator 48 may be carried on the person of the observer 18 and manually operated from a remote location. Alternatively, as shown in FIG. 4, the signal transmitter/generator 48 may be provided on an object, in this case a forklift 50, so that the signal from the transmitter/generator 48 can be directed to the sensor 44 automatically as the forklift 50 comes within a certain range of the sensor 44. That is, the signal transmitter/generator 48 may be continuously operated and set to cause a message, viewable at the first side 20 of the wall 12, to be generated once within a predetermined range. This may be used as a safety measure to alert the driver of the forklift 50 of the entry into a restricted area, or may give further directions or warnings to the operator.

In FIG. 4, the wall 12 is shown suspended by a bracket arrangement 52 from a downwardly facing surface 54 on a support 56. The wall 12 may be mounted in many other different manners, as from a support of some kind upon the floor surface 58, etc.

Figure 5:
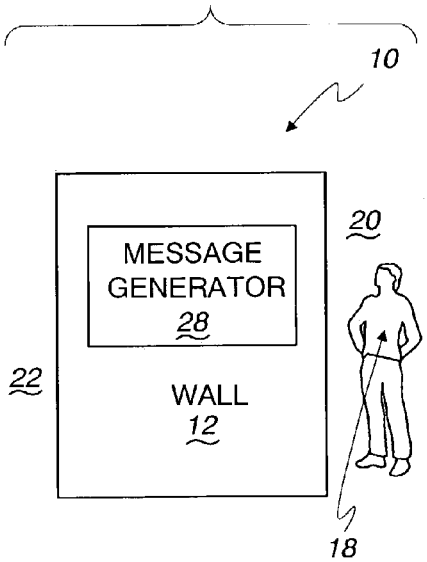
FIG. 5 is a schematic representation of another form of message system, according to the present invention, with the message generator incorporated within the thickness of the wall.
Figure 6:
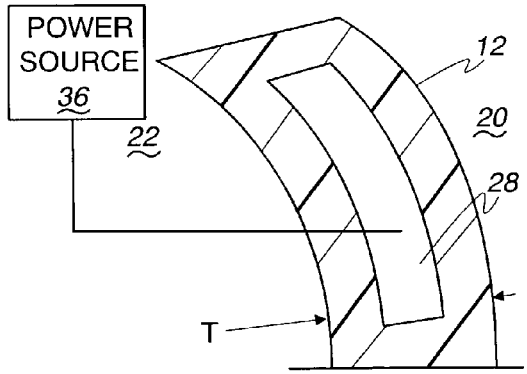
FIG. 6 is an enlarged, fragmentary, partial cross-sectional view of one form of wall, as in the system in FIG. 5, wherein the message generator is self-contained within the thickness of wall.
Figure 7:
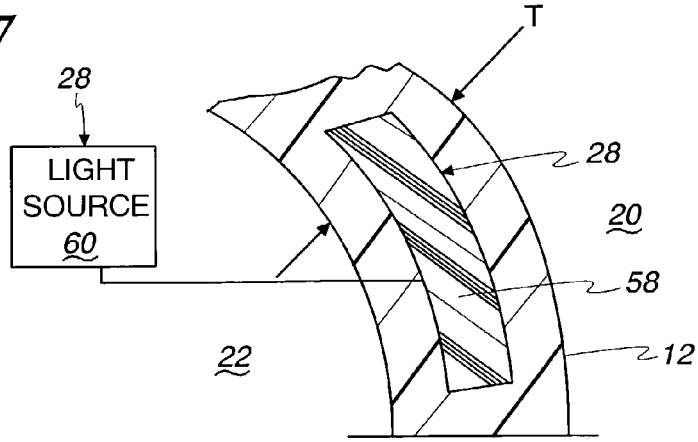
FIG. 7 is a view as in FIG. 6 wherein the message generator includes element(s) for dispersing light from a source to create a message.

While the message generator 28 is shown residing on the second side 22 of the wall 12, it is possible to incorporate the message generator 28 partially or fully within the thickness T of the wall 12, as shown in FIGS. 5–7. This concept is shown generically in FIG. 5.

As seen in FIG. 6, the message generator 28 may be a self-contained system which is capable of producing a message viewable at the first side 20 of the wall 12. The message generator 28 is embedded in the wall 12 and powered by the source 36.

As an alternative, as shown in FIG. 7, the message generator 28 may consist of one or more components 58 embedded in the wall 12, with the component(s) 58 being light transmissive. For example, the components 58 may be discrete fiber optic strands or a continuous material which is capable of dispersing light from a source 60.

Figure 8:
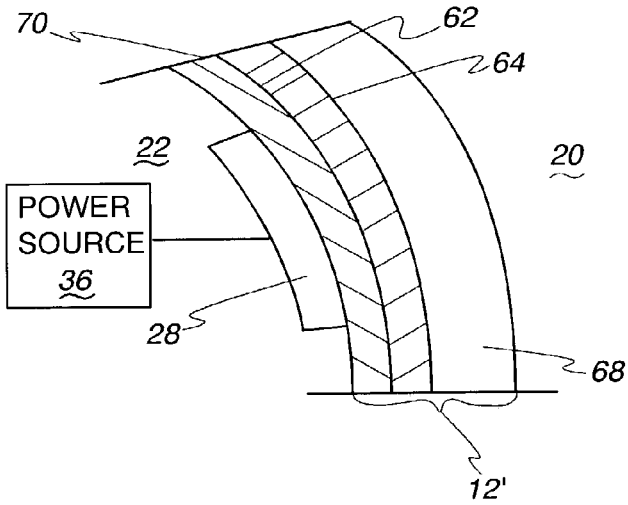
FIG. 8 is a view as in FIG. 7 showing a modified form of wall in the form of a "see-through" mirror and with a message generator, as in FIG. 6, on one side of the wall.

In FIG. 8, a modified form of wall is shown at 12'. The wall 12' has corresponding opposite sides 20,22 and a surface 62 with a reflective mirror coating 64 thereon which is capable of producing a discernible, reflective image of an object placed at the first side of the wall 12'. An optional, covering layer 68 may be applied over the mirror coating 64. A layer 70 defining the surface 62, and the mirror coating 64, are preferably made using "see-through" mirror technology which allows light transmitted on the second side 22 of the wall 12' to be visible at the first side 20 of the wall 12'. The message generator 28 can be placed at the second side 22 of the wall 12' to cause a message, as previously described, to be viewable at the first side 20 of the wall 12'.

Figure 9:
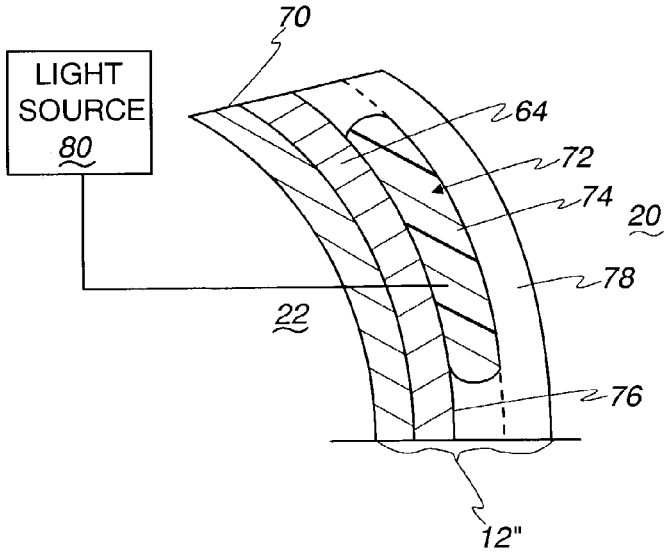
FIG. 9 is a view as in FIG. 8 with the see-through mirror having a message generator, as in FIG. 7, incorporated within the thickness of the wall.

An alternative construction is shown in FIG. 9 and utilizes the layer 70 and mirror coating 64 on a wall 12". In this embodiment, the message generator 72 consists of one or more discrete elements 74 which are placed against a surface 76 of the mirrored coating layer 64. The element(s) 74 may be embedded in a transparent coating layer 78 and may be sufficiently small so as to not be discernible in an unilluminated state. For example, the element(s) 74 may be fiber optic strands which are arranged to disperse light generated at a source 80 in a predetermined manner. The mirror coating 64 need not have a "see through" capability with this construction.

Figure 10:
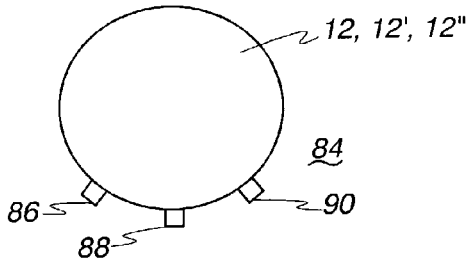
FIG. 10 is fragmentary view of a modified form of wall, according to the present invention, and having multiple sensors which are actuatable to change the state of a message generator associated with the wall.
Figure 11:
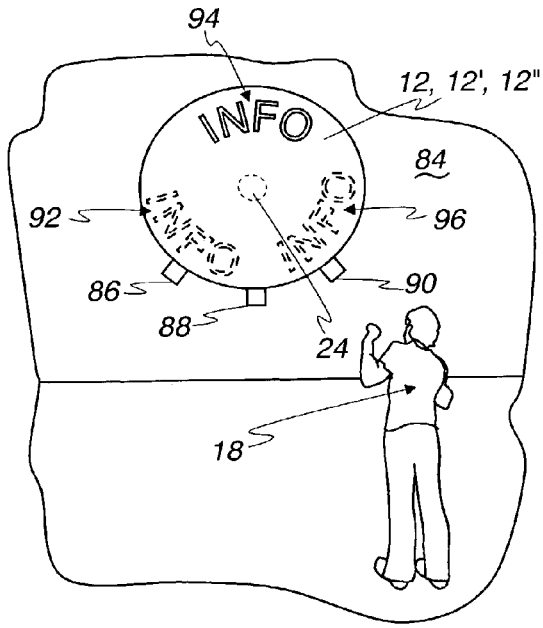
FIG. 11 is a fragmentary view of a modified form of message system, incorporating the wall of FIG. 10, which is operable either manually or in response to detection of the presence of an observer by any of three sensors, to change the state of the message generator.

Another application for the invention is shown in FIGS. 10 and 11. A wall 12, 12', 2" is shown mounted upon a surface 84 and has multiple sensors 86,88,90 that are proximity-type sensors which are activated independently depending upon from which direction the observer 18, or other object, approaches. With the observer 18 at a distance, no message is viewable, as seen in FIG. 10. If the observer 18 approaches from one angle, the sensor 86 causes the message at a location 92 to be viewable. Similarly, the sensor 88 causes the message at a location 94 to be viewable, with the sensor 90 causing a message at a location 96 to be viewable. This arrangement is helpful to give directional information to the observer 18, depending upon the angle of approach. An optional camera 24 is incorporated, as previously described.

Figure 12:
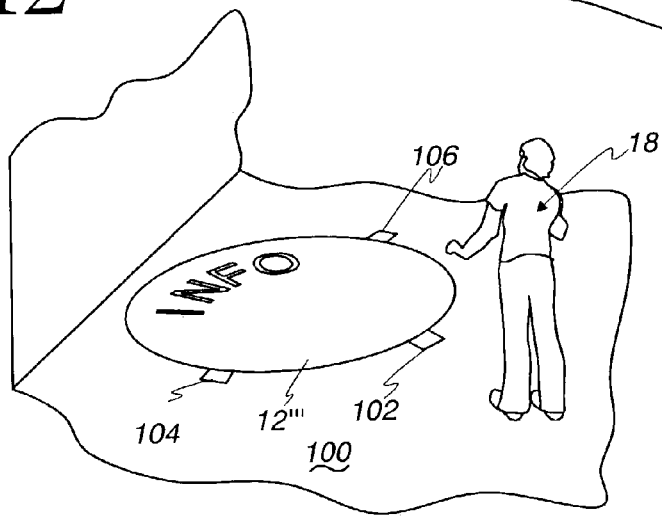
FIG. 12 is a perspective view of a modified form of message system with a wall that is flush mounted on a floor and incorporates a message generator, the state of which can be changed through signals from separate sensors activated by an observer.

The previously described spherical segment configuration for the walls 12, 12', 12" is not intended to be limiting. The spherical segment shape is desirable from the standpoint of producing a space, as for the placement of the surveillance camera 24. Additionally, the spherical segment facilitates viewing of otherwise blind regions which must be navigated, as in warehouses, and the like. However, as shown in FIG. 12, the layer 12''' can be made flat so as to blend into a floor surface 100. Sensors 102, 104, 106 trigger generation of the same or different messages as the observer 18 approaches the wall 12''' from different angles. Virtually any shape for the layer 12 is contemplated, i.e., other than flat and a spherical segment, as previously described.

Figure 13:
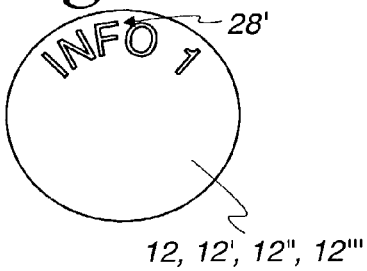
FIG. 13 is an elevation view of a further modified form of wall, according to the present invention, with message generator portions which are superimposed to make different messages viewable at the same location, and with one message in a viewable state.
Figure 14:
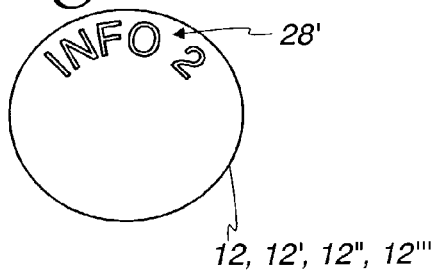
FIG. 14 is a view as in FIG. 13 with another of the messages viewable at the same location.

In FIG. 11, different messages are generated on different portions of the layers 12, 12', 12". It is also possible, as shown in FIGS. 13 and 14, to superimpose portions of a message generator 28' on any of the layers 12, 12', 12", 12''' to allow different messages, as shown in FIGS. 13 and 14, to be made viewable at substantially the same location.

Figure 15:
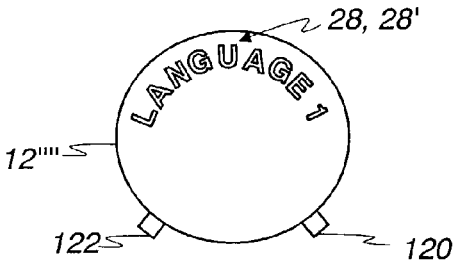
FIG. 15 is an elevational view of a further modified form of wall, according to the present invention, with a message generator producing a first message in a first language.
Figure 16:
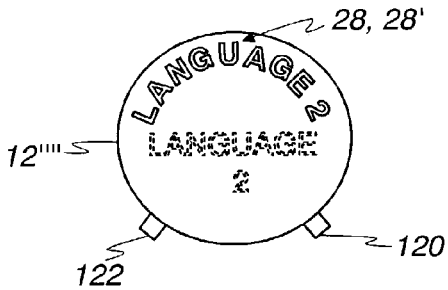
FIG. 16 is a view as in FIG. 15 wherein the message generator is producing a second message in a second language.

In FIGS. 15 and 16, a further modified form of the invention is shown wherein a wall 12"" is shown with a message generator 28, 28' capable of producing messages in different languages, at the same location as shown in solid lines, or in different locations, as shown in dotted lines in FIG. 16. In FIG. 15, a message is displayed in one language, with the message generator 28, 28' in a first state. In FIG. 16, with the message generator 28, 28' in a second state, a message is displayed in a second language. The message generator 28, 28' may be programmed to switch back and forth between the first and second states to alternatingly cause the messages in the first and second languages to be displayed. The substance of the message, with the message generator 28, 28' in the first and second states, may be the same or different.

One or more sensors 120, 122 can be activated to cause the message generator 28, 28' to be operated or to change states. For example, the sensor 120 may be activated to place the message generator 28, 28' in the first state, with the sensor 122 activated to place the message generator in the second state. Alternatively, each sensor 120, 122 could be activated to effect the same operation of the message generator 28, 28', as from different directions in the event that the sensors 120, 122 are proximity sensors.

By utilizing the inventive concept, aside from producing an eye-catching message, the combined functions of space observation through mirrors, discrete surveillance camera mounting, and message generation can be combined to exploit an optimum location for each function and efficiently use this space.

While the invention has been described with particular reference to the drawings, it should be understood that various modifications could be made without departing from the spirit and scope of the present invention.

The invention claimed is:

1. A message system comprising:

a wall having opposite first and second sides and comprising at least one of (a) a mirrored surface which is capable of producing a discernible, reflective image of an object placed at the first side of the wall, and (b) a blocking surface which substantially obstructs viewing of an object at the second side of the wall through the wall from the first side of the wall; and a message generator, the message generator capable of making a message viewable from the first side of the wall through at least a part of the wall, wherein the message system comprises a proximity sensor to detect the presence of an individual or object spaced from the message system at the first side of the wall and, as an incident thereof, cause the message generator to make a message viewable through the mirrored surface or the blocking surface from the first side of the wall.

2. A message system comprising:

a wall having opposite first and second sides and comprising at least one of (a) a mirrored surface which is capable of producing a discernible, reflective image of an object placed at the first side of the wall, and (b) a blocking surface which substantially obstructs viewing of an object at the second side of the wall through the wall from the first side of the wall; and a message generator, the message generator capable of making a message viewable from the first side of the wall through at least a part of the wall, wherein the message system comprises a proximity sensor to detect the presence of an individual or object spaced from the message system at the first side of the wall and, as an incident thereof, cause the message generator to make a message viewable from the first side of the wall, wherein the message generator has first and second states and with the message generator in the first state, a first message is viewable from the first side of the wall and with the message generator in the second state, a second message is viewable from the first side of the wall.

3. The message system according to claim 1 wherein the message generator has first and second states and with the message generator in the first state, a first message is viewable from the first side of the wall and with the message generator in the second state, the first message is not viewable from the first side of the wall.

4. The message system according to claim 1 wherein the message comprises words.

5. The message system according to claim 1 wherein the message comprises at least one of a logo, and a representation of an animate or inanimate object.

6. The message system according to claim 1 wherein the message generator comprises a light source.

7. The message system according to claim 1 wherein the message comprises a light beam.

8. The message system according to claim 1 wherein the message comprises information providing a direction to an observer of the message at the first side of the wall to assist navigation of a space within which the message system is located.

9. A message system comprising:

a wall having opposite first and second sides and comprising at least one of (a) a mirrored surface which is capable of producing a discernible, reflective image of an object placed at the first side of the wall, and (b) a blocking surface which substantially obstructs viewing of an object at the second side of the wall through the wall from the first side of the wall; and a message generator, the message generator capable of making a message viewable from the first side of the wall through at least a part of the wall, wherein the message system comprises a proximity sensor to detect the presence of an individual or object spaced from the message system at the first side of the wall and, as an incident thereof, cause the message generator to make a message viewable from the first side of the wall, the message system further comprising a transmitter/generator that can be carried by a user for directing a signal to the message generator from a location spaced from the message generator.

10. The message system according to claim 1 wherein the wall has a thickness and at least a part of the signal generator resides within the thickness of the wall.

11. The message system according to claim 1 wherein the message generator resides at the second side of the wall.

12. A message system comprising:

a wall having opposite first and second sides and comprising at least one of (a) a mirrored surface which is capable of producing a discernible, reflective image of an object placed at the first side of the wall, and (b) a blocking surface which substantially obstructs viewing of an object at the second side of the wall through the wall from the first side of the wall; and a message generator, the message generator capable of making a message viewable from the first side of the wall through at least a part of the wall, wherein the message generator has first and second states, with the message generator in the first state a message that repeatedly flashes is viewable from the first side of the wall and flashes at a first rate, and with the message generator in the second state a message that repeatedly flashes is viewable from the first side of the wall and flashes at a second rate that is different than the first rate.

13. A message system comprising:

a wall having opposite first and second sides and comprising at least one of (a) a mirrored surface which is capable of producing a discernible, reflective image of an object placed at the first side of the wall, and (b) a blocking surface which substantially obstructs viewing of an object at the second side of the wall through the wall from the first side of the wall; and a message generator, the message generator capable of making a message viewable from the first side of the wall through at least a part of the wall, wherein the message generator has first and second states, with the message generator in the first state a message that is viewable from the first side of the wall is generated for a first predetermined time interval, and with the message generator in the second state a message that is viewable from the first side of the wall is generated for a second predetermined time interval that is different than the first predetermined time interval.

14. A message system comprising:

a wall having opposite first and second sides and comprising at least one of (a) a mirrored surface which is capable of producing a discernible, reflective image of an object placed at the first side of the wall, and (b) a blocking surface which substantially obstructs viewing of an object at the second side of the wall through the wall from the first side of the wall; and a message generator, the message generator capable of making a message viewable from the first side of the wall through at least a part of the wall, wherein the message generator has first and second states, with the message generator in the first state a first message generated by the message generator is in a first language and with the message generator in the second state, a second message generated by the message generator is in a second language.

15. A message system comprising:

a wall having opposite first and second sides and comprising at least one of (a) a mirrored surface which is capable of producing a discernible, reflective image of an object placed at the first side of the wall, and (b) a blocking surface which substantially obstructs viewing of an object at the second side of the wall through the wall from the first side of the wall; and a message generator, the message generator capable of making a message viewable from the first side of the wall through at least a part of the wall, wherein the message system comprises a sensor to detect the presence of an individual or object at the first side of the wall and, as an incident thereof, cause the message generator to make a message viewable from the first side of the wall, wherein the mirrored surface has a convex shape at the first side of the wall that is in the shape of a segment of a sphere.

16. A message system comprising:

a wall having opposite first and second sides and comprising at least one of (a) a mirrored surface which is capable of producing a discernible, reflective image of an object placed at the first side of the wall, and (b) a blocking surface which substantially obstructs viewing of an object at the second side of the wall through the wall from the first side of the wall; and a message generator, the message generator capable of making a message viewable from the first side of the wall through at least a part of the wall, the message system further comprising a transmitter/generator for directing a signal to the message generator from a location spaced from the message generator, said message system further comprising a wheeled vehicle carrying the transmitter/generator, the wall and message generator defining a subassembly at a first location relative to which the wheeled vehicle is spaced and can be moved.

17. A message system comprising:

a wall having opposite first and second sides and comprising at least one of (a) a mirrored surface which is capable of producing a discernible, reflective image of an object placed at the first side of the wall, and (b) a blocking surface which substantially obstructs viewing of an object at the second side of the wall through the wall from the first side of the wall; and a message generator, the message generator capable of making a message viewable from the first side of the wall through at least a part of the wall, said message system further comprising a surveillance camera on the second side of the wall which is capable of creating an image of an object on the first side of the wall viewed by the camera through the wall.

18. A message system comprising:

a wall having opposite first and second sides and comprising at least one of (a) a mirrored surface which is capable of producing a discernible, reflective image of an object placed at the first side of the wall, and (b) a blocking surface which substantially obstructs viewing of an object at the second side of the wall through the wall from the first side of the wall; and a message generator, the message generator capable of making a message viewable from the first side of the wall through at least a part of the wall, wherein an object at the first side of the wall is viewable through the mirrored surface or blocking surface on the wall from the second side of the wall.

19. A message system comprising:

a wall having opposite first and second sides and comprising a surface which substantially blocks viewing of an object at the second side of the wall through a part of the wall from the first side of the wall; and a message generator, the message generator having first and second states, the message generator in the first state causing a first message to be viewable through the part of the wall from the first side of the wall, the first message being unviewable through the part of the wall from the first side of the wall with the message generator in the second state, wherein the message system comprises a proximity sensor to detect the presence of an individual or object spaced from the message system at the first side of the wall and, as an incident thereof, cause the message generator to make a message viewable from the first side of the wall.

20. The message system according to claim 19 wherein the message comprises information providing a direction to an observer of the message at the first side of the wall to assist navigation of a space within which the message system is located.

21. A message system comprising:

a wall having opposite first and second sides and comprising a surface which substantially blocks viewing of an object at the second side of the wall through the wall from the first side of the wall; and a message generator, the message generator having first and second states, the message generator in the first state causing a first message to be viewable at the wall from the first side of the wall, the first message being unviewable from the first side of the wall with the message generator in the second state, wherein the message system comprises a proximity sensor to detect the presence of an individual or object spaced from the message system at the first side of the wall and, as an incident thereof, cause the message generator to make a message viewable from the first side of the wall, the message system further comprising a transmitter/generator that can be carried by a user for directing a signal to the message generator from a location spaced from the message generator.

22. The message system according to claim 19 wherein the signal generator resides at the second side of the wall.

23. The message system according to claim 19 wherein and with the message generator in the second state a second message is viewable from the first side of the wall.

24. A message system comprising:

a wall having opposite first and second sides and comprising a surface which substantially blocks viewing of an object at the second side of the wall through the wall from the first side of the wall; and a message generator, the message generator having first and second states, the message generator in the first state causing a first message to be viewable through the surface at the wall from the first side of the wall, the first message being unviewable through the surface from the first side of the wall with the message generator in the second state, wherein an object on the first side of the wall can be viewed through the surface on the wall from the second side of the wall.

25. The message system according to claim 19 wherein the wall comprises a mirrored surface which is capable of producing a reflective image of an object placed at the first side of the wall.

26. A message system comprising:

a wall having opposite first and second sides and comprising a surface which substantially blocks viewing of an object at the second side of the wall through the wall from the first side of the wall; and a message generator, the message generator having first and second states, the message generator in the first state causing a first message to be viewable at the wall from the first side of the wall, the first message being unviewable from the first side of the wall with the message generator in the second state, wherein the mirrored surface has a convex shape that is in the shape of a segment of a sphere at the first side of the wall.

27. A message system comprising:

a wall having opposite first and second sides and comprising a surface which substantially blocks viewing of an object at the second side of the wall through the wall from the first side of the wall; and a message generator, the message generator having first and second states, the message generator in the first state causing a first message to be viewable at the wall from the first side of the wall, the first message being unviewable from the first side of the wall with the message generator in the second state, wherein the message system comprises a sensor to detect the presence of an individual or object at the first side of the wall and, as an incident thereof, cause the message generator to make a message viewable from the first side of the wall, said message system further comprising a transmitter/generator for directing a signal to the message generator from a location spaced from the message generator, said message system further comprising a wheeled vehicle carrying the transmitter/generator, the wall and message generator defining a subassembly at a first location relative to which the wheeled vehicle is spaced and can be moved.

28. A message system comprising:

a wall having opposite first and second sides and comprising a surface which substantially blocks viewing of an object at the second side of the wall through the wall from the first side of the wall; and a message generator, the message generator having first and second states, the message generator in the first state causing a first message to be viewable at the wall from the first side of the wall, the first message being unviewable from the first side of the wall with the message generator in the second state, wherein with the message generator in the first state a first message generated by the message generator is in a first language and with the message generator in the second state, a second message generated by the message generator is in a second language.

29. A message system comprising:

a wall having opposite first and second sides and comprising a surface which substantially blocks viewing of an object at the second side of the wall through the wall from the first side of the wall; and a message generator, the message generator having first and second states, the message generator in the first state causing a first message to be viewable at the wall from the first side of the wall, the first message being unviewable from the first side of the wall with the message generator in the second state, wherein with the message generator in the first state a message that repeatedly flashes is viewable from the first side of the wall and flashes at a first rate, and with the message generator in the second state a message that repeatedly flashes is viewable from the first side of the wall and flashes at a second rate that is different than the first rate.

30. A message system comprising:

a wall having opposite first and second sides and comprising a surface which substantially blocks viewing of an object at the second side of the wall through the wall from the first side of the wall; and a message generator, the message generator having first and second states, the message generator in the first state causing a first message to be viewable at the wall from the first side of the wall, the first message being unviewable from the first side of the wall with the message generator in the second state, wherein with the message generator in the first state a message that is viewable from the first side of the wall is generated for a first predetermined time interval, and with the message generator in the second state a message that is viewable from the first side of the wall is generated for a second predetermined time interval that is different than the first predetermined time interval.

31. A message system comprising:

a wall having opposite first and second sides and comprising at least one of (a) a mirrored surface which is capable of producing a discernible, reflective image of an object placed at the first side of the wall, and (b) a blocking surface which substantially obstructs viewing of an object at the second side of the wall through the wall from the first side of the wall; and a message generator, the message generator capable of making a message viewable from the first side of the wall through at least a part of the wall, said message system further comprising a transmitter/generator that can be carried by a user for directing a signal to the message generator from a location spaced from the message generator with the user stationary at a location spaced from the message generator.

32. A message system comprising:

a wall having opposite first and second sides and comprising a surface which substantially blocks viewing of an object at the second side of the wall through the wall from the first side of the wall; and a message generator, the message generator having first and second states, the message generator in the first state causing a first message to be viewable at the wall through the wall surface from the first side of the wall, the first message being unviewable from the first side of the wall with the message generator in the second state, wherein the message comprises information providing a direction to an observer of the message at the first side of the wall to assist navigation of a space within which the message system is located.

* * * * *